US008510877B2

(12) United States Patent
Helewa

(10) Patent No.: US 8,510,877 B2
(45) Date of Patent: Aug. 20, 2013

(54) TOILET DEVICE OF THE PIERCED CHAIR TYPE INCLUDING A BOX DESIGNED FROM A PRE-CUT PLANAR BLANK AND A COLLECTION BAG

(75) Inventor: Laurent Helewa, Paris (FR)

(73) Assignee: Cleanis Company, Paris (FR)

( * ) Notice: Subject to any disclaimer, the term of this patent is extended or adjusted under 35 U.S.C. 154(b) by 776 days.

(21) Appl. No.: 12/601,217

(22) PCT Filed: May 21, 2008

(86) PCT No.: PCT/FR2008/000699

§ 371 (c)(1),
(2), (4) Date: Nov. 20, 2009

(87) PCT Pub. No.: WO2009/000979

PCT Pub. Date: Dec. 31, 2008

(65) Prior Publication Data

US 2010/0180370 A1 Jul. 22, 2010

(30) Foreign Application Priority Data

May 21, 2007 (FR) ..... 07 03586

(51) Int. Cl.
*A47K 11/06* (2006.01)

(52) U.S. Cl.
USPC ..... 4/484

(58) Field of Classification Search
USPC ..... 4/484, 449, 483, 460, 479; 248/174; 297/440.12; D19/75; 229/117, 138–139, 229/142, 145, 155, 192, 185.1, 131.1, 149, 158, 151; 220/404
See application file for complete search history.

(56) References Cited

U.S. PATENT DOCUMENTS

| | | | | | |
|---|---|---|---|---|---|
| 1,026,413 | A | * | 5/1912 | Sullivan | 4/460 |
| 1,955,385 | A | * | 4/1934 | Gray | 220/495.11 |
| 2,220,388 | A | * | 11/1940 | Beaman et al. | 229/181 |
| 2,332,250 | A | * | 10/1943 | O'Reilly | 229/117 |
| 2,610,782 | A | * | 9/1952 | McReary | 229/125.19 |
| 2,726,803 | A | * | 12/1955 | Ketler | 229/5.5 |
| 2,747,732 | A | * | 5/1956 | Fischer | 206/395 |
| 2,809,777 | A | * | 10/1957 | Davidson | 229/148 |
| 2,849,726 | A | * | 9/1958 | Vay | 4/476 |
| 2,893,017 | A | * | 7/1959 | Beck | 4/476 |
| 2,912,702 | A | * | 11/1959 | Mackenzie | 4/476 |
| 2,918,205 | A | * | 12/1959 | Zeitter | 229/102 |

(Continued)

FOREIGN PATENT DOCUMENTS

| | | |
|---|---|---|
| JP | 02 119828 A | 5/1990 |
| JP | 11 155766 A | 6/1999 |

*Primary Examiner* — Lori Baker

(74) *Attorney, Agent, or Firm* — Workman Nydegger

(57) ABSTRACT

A toilet device including a box assembled from a flat pre-cut cardboard blank and a urine and feces collection bag includes (i) a box furnishing by way of folding and consolidation, an opening (2) in its panel (1) serving as a seat, a least two double sidewalls produced by a consolidation of angularly spaced panels (12/10*a* and 12*a*/10) and a double wall on the level of the bottom produced by the consolidation of the panels (20, 20*a*) and (ii) a collection bag impervious to gases and liquids, in particular made of plastic, whose upper peripheral part entirely covers the panel (1) which serves as a seat and whose bottom which contains a gelling agent, dips into the said opening (2), the said bag being fixed during use to the said box by the V slots (70, 71) and half-V slots (70*a*, 71*a*).

9 Claims, 2 Drawing Sheets

(56) References Cited

U.S. PATENT DOCUMENTS

| | | | | | |
|---|---|---|---|---|---|
| 3,063,615 | A | * | 11/1962 | Bronte et al. | 229/122.32 |
| 3,097,016 | A | * | 7/1963 | Bigler, Jr. | 297/440.12 |
| 3,118,146 | A | * | 1/1964 | Dorey | 4/476 |
| 3,126,140 | A | * | 3/1964 | Lizan et al. | 229/117.01 |
| 3,142,847 | A | * | 8/1964 | Kurrels | 4/484 |
| 3,159,848 | A | * | 12/1964 | Arndt, Jr. | 4/476 |
| 3,178,093 | A | * | 4/1965 | Wasyluka | 229/172 |
| 3,285,492 | A | * | 11/1966 | Demby et al. | 206/175 |
| 3,286,900 | A | * | 11/1966 | Keith | 229/138 |
| 3,444,563 | A | * | 5/1969 | Gordon, Jr. | 4/484 |
| 3,579,655 | A | * | 5/1971 | Sunberg | 4/476 |
| 3,600,719 | A | * | 8/1971 | Karr | 4/476 |
| 4,403,729 | A | * | 9/1983 | Wytko | 229/149 |
| 4,583,678 | A | * | 4/1986 | Weimer, Jr. | 229/185 |
| 4,621,380 | A | * | 11/1986 | McGill | 4/476 |
| 4,648,658 | A | * | 3/1987 | Calco | 297/440.12 |
| 4,710,989 | A | * | 12/1987 | Grenthe | 4/449 |
| 4,767,051 | A | * | 8/1988 | Single | 229/117 |
| 4,895,250 | A | * | 1/1990 | Schifrin | 206/223 |
| 4,995,122 | A | * | 2/1991 | Mohnhaupt | 4/483 |
| 5,080,044 | A | * | 1/1992 | Bosworth | 119/168 |
| 5,187,819 | A | * | 2/1993 | Grimes | 4/483 |
| D339,231 | S | * | 9/1993 | Perry | D3/284 |
| 5,265,285 | A | * | 11/1993 | Loebbert | 4/484 |
| 5,356,022 | A | * | 10/1994 | Tipps | 229/117.3 |
| 5,415,475 | A | * | 5/1995 | Sandy | 383/8 |
| 5,448,785 | A | * | 9/1995 | Lin | 4/484 |
| 5,524,301 | A | * | 6/1996 | McGuire | 4/460 |
| 5,682,623 | A | * | 11/1997 | Fenoglio | 4/483 |
| 5,732,418 | A | * | 3/1998 | Sekitou | 4/449 |
| 6,016,952 | A | * | 1/2000 | Smith et al. | 229/117 |
| 6,047,414 | A | * | 4/2000 | Bailey | 4/484 |
| 6,048,032 | A | * | 4/2000 | Stewart | 297/440.12 |
| D424,117 | S | * | 5/2000 | Steinbeck et al. | D19/75 |
| 6,206,473 | B1 | * | 3/2001 | Kondratiev | 297/440.1 |
| 6,676,010 | B1 | * | 1/2004 | Roseth et al. | 229/114 |
| 6,948,616 | B2 | * | 9/2005 | Gillani | 206/459.5 |
| 7,086,097 | B2 | * | 8/2006 | Shin | 4/144.2 |
| 7,247,360 | B1 | * | 7/2007 | Besner et al. | 428/42.1 |
| 7,540,041 | B2 | * | 6/2009 | Gara et al. | 4/483 |
| 7,597,242 | B2 | * | 10/2009 | Covelli | 229/122 |
| 7,625,047 | B2 | * | 12/2009 | Bertele | 297/440.12 |
| 7,770,242 | B2 | * | 8/2010 | Sell | 4/484 |
| 7,819,305 | B2 | * | 10/2010 | Little | 229/122.32 |
| 7,841,512 | B2 | * | 11/2010 | Westerman et al. | 229/125.28 |
| 7,861,916 | B2 | * | 1/2011 | Little | 229/120.26 |
| 7,981,017 | B2 | * | 7/2011 | Little et al. | 493/51 |
| 7,996,930 | B2 | * | 8/2011 | Carter et al. | 4/484 |
| 8,177,117 | B2 | * | 5/2012 | Little | 229/120.18 |
| 8,209,793 | B2 | * | 7/2012 | Carter et al. | 4/483 |
| 8,240,770 | B2 | * | 8/2012 | Bertele | 297/440.12 |
| 2006/0150312 | A1 | * | 7/2006 | Gara et al. | 4/483 |
| 2007/0233028 | A1 | * | 10/2007 | Roe et al. | 604/361 |

* cited by examiner

TOILET DEVICE OF THE PIERCED CHAIR TYPE INCLUDING A BOX DESIGNED FROM A PRE-CUT PLANAR BLANK AND A COLLECTION BAG

FIELD OF INVENTION

As a new industrial product, the present invention concerns, on the one hand, a toilet device of the commode type, consisting of a box and of a collection bag, produced and assembled from a flat, pre-cut cardboard blank without the use of an adhesive, of adhesive tape or of staples. It likewise concerns the use of the said toilet for the elimination of mephitic odours.

PRIOR ART

It is known that during their outdoor activities, schoolchildren visiting the countryside as a group are in the habit (1) of relieving themselves against trees, or in copses and (2) to leave their waste (urine, faeces and pieces of wiping paper) on the ground. It is likewise known that during exercises, or during operations, troops of soldiers are in the habit (1) of digging trenches to receive their waste and (2) of covering the trench with soil before breaking camp. In either case there is a major risk of contaminating the soil, especially by strains of *Staphylococcus aureus*, or (more seriously) of *Staphylococcus faecalis*, which are liable to infect both humans and animals.

It is particularly difficult to transport chemical WC cabins, which are heavy and cumbersome, in order to deal with calls of nature of children and/or of adults during trips to the countryside.

In order to deal with this problem, consideration was given to the use of pre-cut blanks to assemble on the spot simple boxes, each of whose upper, lower and side walls would consist of a single panel and which would be provided with an opening in the upper wall in which it would be possible to accommodate a bag for the collection of waste (urine, faeces and paper). Nevertheless, many boxes of this type are not suitable, such as, for example, the so-called American box, which consists of a top and two caps, which calls for the transport of adhesive for fastening the caps to the top the so-called "filing" box, which comprises an enclosure with four flaps, which interlock at the moment of being used and a cap, which becomes irreversibly deformed under the weight of an adult.

There is also European Patent EP 0 948 304 B, which mentions a single use waste collection bag, which is impervious and contains a gelling agent which swells by the absorption of the water present in the waste, to (1) coat a bedpan provided for sick, bedridden and handicapped persons and to (2) close the collection bag containing the waste of a patient by means of at least one sliding tie (i.e. a tightening cord) located in a hem running along the opening of the said bag, and then to tie (i.e. to make several turns and at least one knot with the said tie under the upper part of the bag and above the absorbed or coated waste), to (3) extract the said bag from the bedpan without its having become contaminated and then to (4) proceed to the normal incineration of the used bag. The bedpan collection bags complying with the said patent EP 0 948 304 B are greatly appreciated by hospital personnel.

The ideal would be to have flat blanks to assemble on the spot (i) equipped with such impervious bags containing the said gelling agent as referred to in the aforementioned EP 0 948 304 B and (ii) able to withstand the weight of users without having to transport or use adhesives or adhesive tape with its reel (where the mass of the adhesive is very heavy and where specialists refer to "aggressively adhesive" adhesive mass), or staples and their staple gun.

PURPOSE OF THE INVENTION

The invention concerns a new technical solution for dealing with the aforementioned problems and for providing as far as possible an ideal product. This objective is met by providing a box, possessing as a result of folding and consolidation an opening in its upper part to receive a collection bag at least two double sidewalls located opposite one another or angularly spaced a double wall at the bottom

OBJECT OF THE INVENTION

According to a first aspect of the invention, a toilet of the commode type is provided (taking into account drawing references), which is able to be easily assembled from a flat pre-cut blank without the use of adhesive, adhesive tape or staples and comprising a cardboard box having in its upper part a (1) horizontal panel serving as a seat and provided with an opening (2) connecting the internal cavity of the said box with the outside and a single-use waste (urine and faeces) collection bag, which is impervious to gases and liquids and which extends through the said opening (2) into a portion of the internal cavity, the said toilet which comprises flat panels interlinked by folding ribs (80, 80*a*, 81, 81*a*, 82, 82*a*, 83, 83*a*, 90), in particular by weakening of the material and means of consolidation of the type of extension feet lodging in the slots, characterised by the presence of at least two double side walls consisting of panels (10,10*a*, 12, 12*a*) rendered vertical and consolidated by a set of extension feet (51, 52, 53 and respectively 54) and homologous slots (51*a*, 52*a*, 53*a* and respectively 54*a*)

a base, which is a horizontal double wall consisting of the cladding of two panels (20, 20*a*) consolidated by at least one extension foot (60, 61) on one of them and at least one homologous slot (60*a*, 61*a*) on the other one.

two V-shaped slots (70, 71) each provided on the vertical ribs of the said box opposite one another (81, 81*a*), the apex of the V being directed downwards and the branches of each V extending in the direction of the horizontal panel (1) serving as a seat, in the mass of the side panels (10, 11, 10*a*, 11*a*) connected to each of the vertical ribs (81, 81*a*), each internal panel (12, 12*a*) of the double sidewalls comprising a half V-shaped slot (70*a*, 71*a*), which must be disengaged opposite the leg of the V of the outside covering panel (10, 10*a*) when the said double walls are formed and a collection bag impervious to gases and liquids, in particular one made of plastic, whose upper peripheral part covers the entire panel (1) serving as a seat and whose base which contains a gelling agent, drops through the said opening (2) into the internal cavity of the said box, the said bag being fixed to the said box whilst in use by means of the said V-slots, in particular via at least one sliding tie inserted into the hem running along the entire length of the open top of the said bag.

According to a second aspect of the invention, a flat pre-cut cardboard blank is provided, able to be used for assembling the box of the commode according to the invention, the said flat pre-cut blank being characterised by comprising

- a square central panel (1) provided with an opening (2) destined to receive following assembly the said collection bag and if necessary, comprising at least one slot (3, 3*a*) able to keep the cover (5) in a closed or turned down position
- a first series of three panels (10, 11, 12) with two folding lines having to constitute the folding ribs following assembly, one (81) between the panels (10) and (11), the other (82) between the panels (11) and (12), the said first series being fastened by a folding line (80) to the said panel (1) which must serve as a seat, located between the said panels (1) and (11)
- a second series of three panels (10*a*, 11*a*, 12*a*) analogous to the said first series and offset by an angle π, the outermost panels (10 and respectively 12) of the first series each being provided with an extension foot (51 and respectively 52) destined to enter for consolidation the corresponding slot (51*a* and respectively 52*a*) arranged in the vicinity of the folding line (82*a* and respectively 81*a*) of the outermost panel homologous with the centre panel (11*a*) of the second series on the one hand and the outermost panels (12*a* and respectively 10*a*) of the second series, each being provided with another extension foot (53 and respectively 54) destined to enter the corresponding slot (53*a* and respectively 54*a*) arranged in the vicinity of the corresponding folding line (81 and respectively 82) of the panels of the first series of the other hand.
- a panel (20) connected by a folding line (83) to the centre panel (11) of the first series of panels of the side opposite panel (1) which must serve as a seat and a homologous panel (20*a*) connected to the centre panel (11*a*) of the second series of panels, the said panels (20, 20*a*) closing after assembly the double wall of the bottom of the box, at least one extension foot (60, 61) destined for one of the panels (20, 20*a*) and the corresponding slot (60*a*, 61*a*) being provided on the other and serving for their consolidation and
- a panel (5) connected by a folding line (90) to the said panel (1) having to serve as a seat, the said panel (5) having to serve as a cover able to rotate about the said folding line (90) and arranged in a gap between the first and second series of panels, the said cover being provided with at least one foot (4, 4*a*) to enter perpendicularly during closing into the corresponding slot (3, 3*a*) of the said panel (1).

According to yet another (third) aspect of the present invention, a new application is furnished of a commode, the said new application being characterised by the fact device according to the invention is resorted to, which comprised a collection bag impervious to gases and liquids in which a gelling agent which swells in contact with water is associated with a deodorant, in particular charcoal, in order to eliminate mephitic odours (i.e. the nauseating and intolerable odours of urine and faeces).

BRIEF DESCRIPTION OF THE DRAWINGS

In the appended drawings

DETAILED DESCRIPTION OF THE INVENTION

Figure 1:
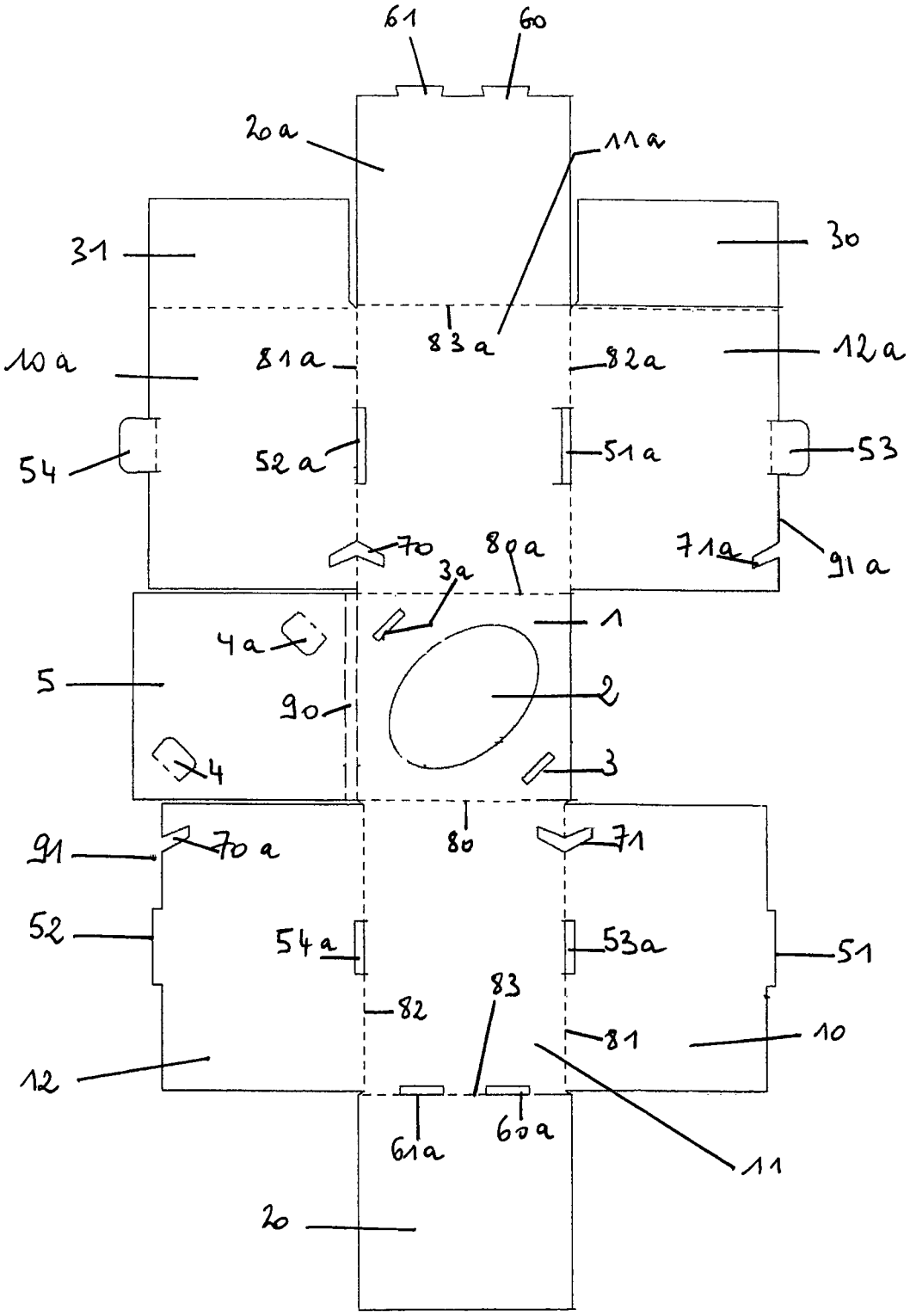
FIG. 1 shows a flat blank according to the invention, to be assembled and consolidated into a device according to the invention
Figure 2:
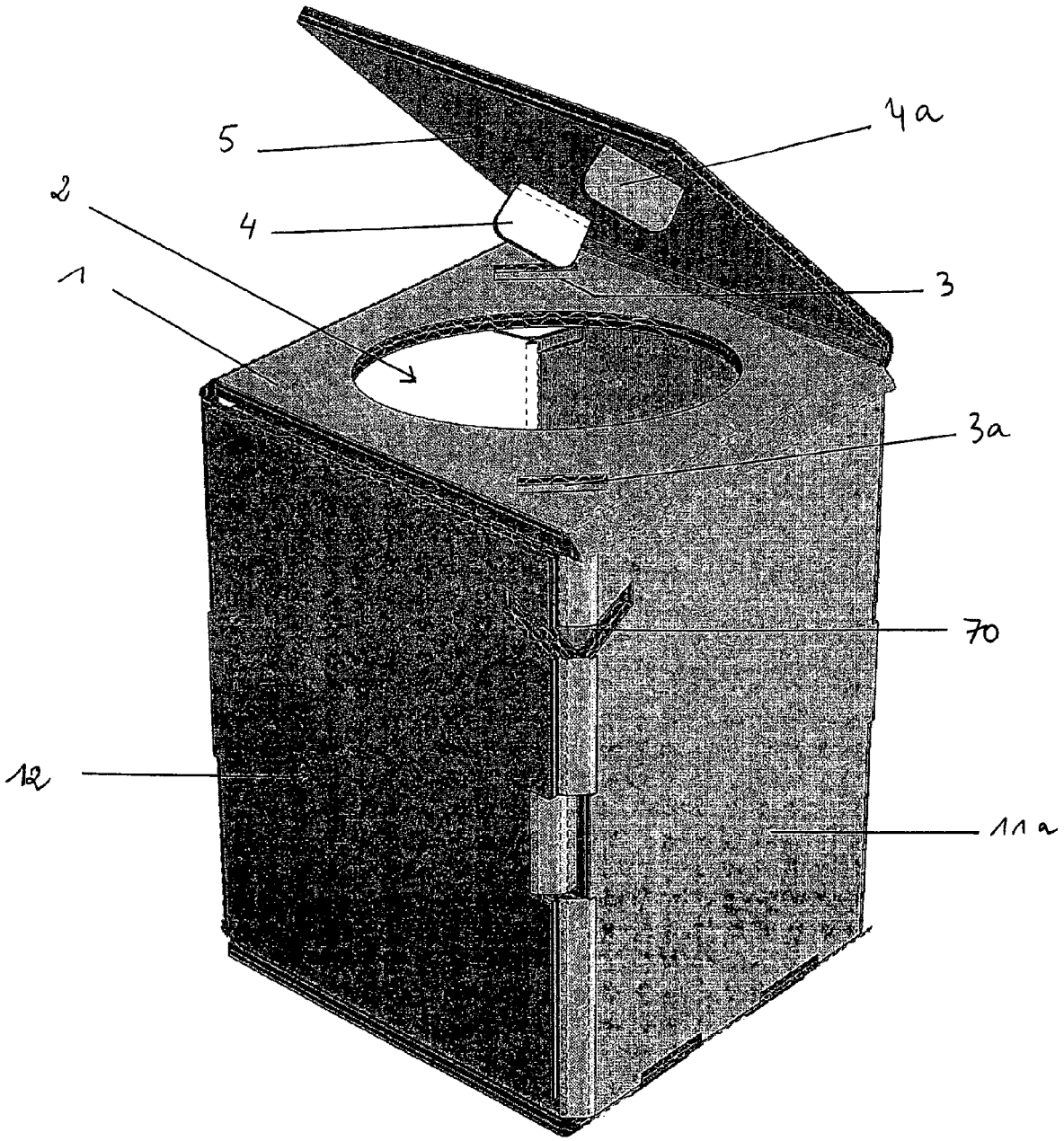
FIG. 2 is a perspective view of a commode according to the invention

Panel (1) of the device according to the invention, which serves as a seat, is polygonal, has an even number 2n of sides and the vertical axis of symmetry is the axis of the box, n being a whole number equal to or greater than 2 and having, in particular, the value of 2, 3 or 4; the preferred value being accordingly n=2, the said panel (1) being a rectangle or better still, a square.

Moreover, the said panel 1 which serves as a seat, is connected to at least two series, each consisting of n+1 panels, namely to a first series of panels (10, 11, 12) along a folding rib (80) through a panel (11) located between panel n° 1 (10) and n° n+1 (12) and at least a second series of panels (10*a*, 11*a*, 12*a*) analogous to the first series and angularly offset from the latter by an angle 2π/n, the said angle being π/2 (where n=4), 2π/3 (where n=3) or π (where n=2).

The number of double sidewalls advantageously goes from 2 (where n=2) to n (where n is greater than 2) and the said double walls are formed by consolidating the first panel (10) of one series with the last panel (12*a*) of the series which angularly follows.

According to a preferred embodiment, the device according to the invention is characterised by the fact that panel (1) which serves as a seat, is rectangular, or better still, square (n=2), is connected to the said first series of panels comprising three side panels (10, 11, 12) by means of a fold (80) attaching it to the central panel (11) of the said first series and to the second series opposite (10*a*, 11*a*, 12*a*), angularly offset by an angle π via a fold (80*a*) connecting it to the centre panel (11*a*) of the said second series, the double side walls being formed by the consolidation of the pair of the outermost side panels (10, 12*a*, 10*a*, 12)

In the first series of three side panels (10, 11, 12) the centre panel (12) is connected to panel (1) which serves as a seat via the folding rib (80). It is this centre panel (11), which makes it possible to connect the first series to the said panel (1), since the said panel (11) is also connected to one of the outermost panels (10) by the folding rib (8) and to the other (12) by the folding rib (82).

In the second series of side panels (10*a*, 11*a*, 12*a*), the centre panel (11*a*) is arranged analogously. It is connected to panels (1, 10*a* and respectively to 12*a*) by means of folding ribs (80*a*, 81 and respectively 82*a*)

The device according to the invention may also comprise a cover consisting of a panel (5) connected via a horizontal folding rib (90) to panel (1) serving as a seat and comprising at least one extension foot (4, 4*a*), which is destined when the said cover is closed, to enter perpendicularly into a corresponding slot (3, 3*a*) provided in the said panel (1) which serves as a seat.

If necessary, it is possible to provide on at least one of the first and second series of side panels, flaps (30, 31) in order to improve the resistance of the box to the weight of users. In FIG. 1, a first flap (30) is connected to the outermost panel (12*a*) by a folding rib and a second flap (31) is connected to the outermost panel (10*a*) of the second series of panels.

The V slots (70 and respectively 71) whose apices are arranged on the folding ribs (81 and respectively 82) and the branches, are deployed obliquely upwards in the direction of panel (1) serving alongside the half-V slots (70*a* and respectively 71*a*) provided in the vicinity of the edges (91 and respectively 91*a*) of the outermost panels (12 and respectively 12*a*) for fastening the collection bag (not shown) to the commode in such a way that it covers at the top the whole of panel (1) serving as a seat. The collection bag whose bottom is lodged in the internal cavity of the commode by its opening (2) is consolidated at the moment of the use of the said box by means of the aforementioned sliding connection which is lodged in a hem or a belt running the entire length of the open top of the said bag. It is this sliding connection, which enters into the slots (70, 70*a*, 71, 71*a*).

The single-use collection bag, which is impervious to gases and liquids, is made of plastic or of a composite material where the outside is of paper or of a woven or non-woven fabric and the inside of plastic and the said bag contains a gelling agent which swells on contact with water in urine or faeces to absorb the said urine and to coat the said faeces. The gelling agent may be a polyacrylate, as stated in the aforementioned EP 0 948 304 B, or it may consist of particles of polyurethane, or of finely divided colloidal silica. The advantage of particles of finely divided colloidal silica resides in the fact that they possess a deodorant effect. The deodorant effect of charcoal is however greater than that of the said silica particles.

The device according to the invention is particularly useful (i) for groups of schoolchildren, or of soldiers going to places where there are no clean WC's and (ii) for building site personnel. When travel is required, one transports one or more flat cardboard blanks and a quantity of collection bags statistically adequate for the duration and for the number of persons who may require them are transported and one or more commodes are assembled.

After use, it is sufficient to close the open top of the bag using the sliding closure and to roll it up, making at least one knot. The bag is then dropped into the inside cavity of the box, because there are no mephitic odours, particularly if a deodorant has been added to the gelling agent. Lastly, the box and its contents are incinerated the same evening, or the following day.

The invention claimed is:

1. A foldable toilet having at least one pre-cut flat blank, the toilet comprising:

a cardboard box comprising:

a horizontal seat panel provided with an opening connecting an internal cavity of said box to the outside;

at least two double sidewalls comprised of panels adjusted into vertical position and consolidated by a set of extension feet and of homologous slots;

a bottom which is a double horizontal wall, the bottom being comprised of two panels consolidated by at least one extension foot on one of them and at least one homologous slot on the other; and a plurality of vertical ribs, each vertical rib being formed along a fold line of the panels forming the sidewalls, two V-shaped slots being provided on the vertical ribs that are opposite one another, an apex of each V-shaped slot being directed downwards and branches of each V-shaped slot extending obliquely in the direction of the horizontal seat panel, each internal panel of the double side walls comprising a half-V slot that is aligned with a corresponding V-shaped slot; and a collection bag impervious to gases and liquids whose upper peripheral part completely covers the seat panel and whose bottom contains a gelling agent and drops through the said opening into the internal cavity of the said box, the said bag being fastened during use to the said box by the said V slots by at least one sliding fastener inserted into a hem running along the entire length of the open top of the said bag.

2. A device according to claim 1, wherein said seat panel has an even number 2n of sides and has as vertical symmetrical axis, n being a whole number equal to, or greater than 2.

3. A device according to claim 2, wherein said seat panel is connected to at least two series of panels, each series of panels comprising n+1 panels:

to a first series of panels along one folding rib via panel located between panels N° 1 and N° n+1; and to at least a second series of panels analogous to the first and angularly offset to the latter at an angle of $2\pi/n$, (where n=4, $2\pi/3$ (where n=3) or $\pi$ (where n=2).

4. A device according to claim 2 wherein the number of double side walls goes from 2 (where n=2) to n (where n is greater than 2) and wherein said double walls are formed by the consolidation of a first panel of one series with the last panel of the series which follows angularly.

5. A device according to claim 1, further comprising a cover having a panel (5) connected by a horizontal folding rib to said seat panel serving as a seat and comprising at least one extension foot destined, on the closure of the said cover, to enter perpendicularly into a corresponding slot provided in said seat panel.

6. A device according to claim 1, wherein said seat panel is rectangular or square and is connected to the said first series comprising three lateral side panels via a fold connecting it to the central panel of the said first series and to the second series opposite angularly offset by an angle $\pi$ via fold connecting it to the central panel of the said second series, the double side panels being formed by the consolidation of two at a time of the outermost side panels.

7. A device according to claim 1, wherein said single use collection bag which is impervious to gases and liquids is made of plastic or of a composite material comprising an outside of paper or of woven or non-woven fabric and an inside of plastic and contains a gelling agent which swells on contact with water from urine or faeces absorbing the said urine and coating the said faeces.

8. A device according to claim 7, wherein said collection bag also contains a deodorant.

9. A foldable toilet comprising:

a cardboard box comprising:

an internal cavity;

a horizontal seat panel formed at an upper part of the cardboard box and having an opening formed thereon, the opening communicating with the internal cavity;

at least two double sidewalls, each double sidewall comprising:

an external side panel having an extension foot projecting therefrom and an internal side panel having a homologous slot formed thereon, the side panels of each double sidewall being vertically orientated and connected together by the external side panel overlaying the internal side panel and the extension foot being received within the slot;

each internal side panel having an extension foot projecting therefrom connected to a slot formed thereon near the folding line of each external side panel;

a bottom which is a double horizontal wall, the bottom being comprised of two bottom panels that are connected together by at least one extension foot projecting from one of the bottom panels being received within an homologous slot formed on or adjacent to the other bottom panel;

a plurality of vertical ribs, each vertical rib being formed along a fold line of the side panels, a V-shaped slot being formed on two opposing vertical ribs, each V-shaped slot having an apex directed downwards and branches that extend toward the seat panel at an oblique angle relative to vertical; and a half-V slot formed on each internal panel of the double side walls, each half-V slot being aligning with a corresponding V-shaped slot; and a collection bag made of plastic, the collection bag having an upper peripheral part that completely covers the seat panel and a bottom part containing a gelling agent, the bottom part extending down through the opening of the seat panel and into the internal cavity of the box, the collection bag further comprising an open top formed at the upper peripheral and a hem formed along the open top, a sliding fastener being received within the hem, the collection bag being fastened to the box by the sliding fastener drawing a portion of the collection bag into each of the V-shaped slots.

* * * * *